United States Patent [19]

Koboshi et al.

[11] 4,336,324

[45] Jun. 22, 1982

[54] METHOD FOR THE PROCESSING OF SILVER HALIDE COLOR PHOTOGRAPHIC LIGHT-SENSITIVE MATERIALS

[75] Inventors: Shigeharu Koboshi; Masayuki Kurematsu, both of Hino, Japan

[73] Assignee: Konishiroku Photo Industry Co., Ltd., Tokyo, Japan

[21] Appl. No.: 273,253

[22] Filed: Jun. 12, 1981

[30] Foreign Application Priority Data

Jun. 18, 1980 [JP] Japan ..... 55-83068

[51] Int. Cl.[3] ..... G03C 7/00

[52] U.S. Cl. ..... 430/372; 430/421; 430/463

[58] Field of Search ..... 430/372, 398, 421, 463

[56] References Cited

U.S. PATENT DOCUMENTS

| | | | |
|---|---|---|---|
| 3,335,004 | 8/1967 | Wrisley et al. | 430/372 |
| 3,356,502 | 12/1967 | Nasu et al. | 430/421 |
| 3,676,136 | 7/1972 | Mowrey | 430/372 |
| 3,909,267 | 9/1975 | Iwano et al. | 430/372 |
| 4,138,256 | 2/1979 | Chylewski et al. | 430/421 |

*Primary Examiner*—J. Travis Brown

*Attorney, Agent, or Firm*—Linda G. Bierman; Jordan B. Bierman

[57] ABSTRACT

A method of stabilization using a plurality of baths which are replenished by a multi-stage counterflow system with the final bath having a pH of from 2.0 to 6.5.

4 Claims, No Drawings

METHOD FOR THE PROCESSING OF SILVER HALIDE COLOR PHOTOGRAPHIC LIGHT-SENSITIVE MATERIALS

The present invention relates to a method for the processing of silver halide color photographic light-sensitive materials, and more particularly to a method for the processing of silver halide color photographic light-sensitive materials capable of forming an excellent quality image stable in a longtime storage after processing even in the case of excluding the washing process.

In general, a color photographic image can be formed by color developing an imagewise exposed silver halide color photographic light-sensitive material in a color developing solution containing an aromatic primary amine developing agent such as p-phenylenediamine and the like, followed by bleaching, fixing, washing and stabilizing processes. In the course of the above processing, in order to accelerate the processing operation, a bleach-fixing process is usually applied which effects simultaneously both bleaching and fixing.

Although the color photographic image obtained through such processing is permanently storable as a record, there may sometimes occur such an undesirable phenomenon that the image is faded or discolored by being subjected to the atmospheric moisture, temperature or light during the period of the storage.

The above-described stabilization process is the process required to further increase the stability of the foregoing photographic image in permanent storage. Such stabilization processes are described in, e.g., U.S. Pat. Nos. 2,647,057, 2,788,274, 2,913,338, 3,667,952, 3,676,136, 2,515,121, 2,518,686, 3,140,177, 3,291,606 and 3,093,479, Japanese Patent Examined Publication Nos. 8779/1962, 5735/1973 and 32369/1973, Japanese Patent Publication Open to Public Inspection (hereinafter referred to as Japanese Patent O.P.I. Publication) No. 107736/1974, DOS No. 1770074, DOS No. 1919045 and DOS No. 2218387.

However, every method described in the above publications is somewhat effective for the stabilization of color photographic images, but is by no means satisfactory. The conventional stabilization processes utilizing these methods have been of monobath constitution designed to be suited for short-period processing, so that they have been unable to meet the demand for the reduction of water pollution and for saving the consumption of washing water.

Further, although there is known such a stabilization method eliminating the washing process as described in U.S. Pat. No. 3,335,004 and the like, the method is of a silver stabilization process using a thiocyanate and also containing a large quantity of a sulfite, so that it tends to transform the resulting image dye to be a leuco-compound. Therefore, there is the possibility that it largely causes the color photographic image to be deteriorated and also causes the occurrence of sulfurous acid gas in a lower pH value. On the other hand, in recent years improvements in photographic color formers have made remarkable progress, resulting in the outstandingly high durability of color formers themselves. As a result it has enabled the elimination of the stabilization process from some of the processing methods which require the ordinary washing process.

In color photographic processings generally performed, however, there still exists close relations between the stability of color photographic images in storage and the washing process. Black-and-white photographic light-sensitive materials whose images are composed of metallic silver itself requires the washing period of time of from 1 to 2 hours for the permanent storage of the images, while color photographic light-sensitive materials, since they have no silver images thereinside after bleaching, are less influenced by the residual thiosulfate than black-and-white materials, so that the washing period of time is permitted to be considerably reduded, yet, somewhat washing time is necessary.

In the meantime, in the photofinisher which operates automatically, successively the color photographic processing, the proctection of environment, curtailment and recovery of water and silver resources are regarded as important, so that there have arisen strong demands to take measures for establishing the antipollution method, the method for the efficient recovery of silver, the reduction and recycling of washing water. For this reason, the recent photographic processing procedures apply such a method as to recover the silver which flows into washing water, or to discharge washing water after making it free from pollution. However, it leaves such a problem that the washing requires a large quantity of water with a small silver ion concentration resulting in a small degree of pollution, whereas the recovery and non-pollution measures require large-scale equipment, and yet its efficiency cannot be sufficiently high.

As some solutions to the above problem, Japanese Patent O.P.I. Publication No. 7793/1980, Japanese Patent Application Nos. 113419/1979 and 148241/1979 provide such proposals as a method for reducing the amount of washing water, a pre-washing process with the use of a small quantity of water between the fixing and washing processes, and the like.

However, there arises such a new problem that if the amount of washing water is largely decreased or if without increasing the water quantity or time of the subsequent washing the pre-washing is performed to such an extent as to raise the efficiency of the recovery of the silver ions brought in from the fixing bath or the efficiency of eliminating the pollution load, the preservability of the color photographic image is significantly harmed, and there are extreme cases where yellow stain occurs on the image even in a short period storage; this is by no means a rare thing. Further, there is such another disadvantage that in the pre-washing bath or washing bath containing a small quantity of water into which is mixed the brought-in fixing or bleaching chemical content, the pH value of the washing water is raised, producing precipitates or moulds which may sometimes give rised to not only the deterioration of the preservability of the color photographic image but a trouble of the processing.

Therefore, it is a first object of the present invention to provide a method for the processing of a silver halide color photographic light-sensitive material capable of forming color photographic images stable in permanent storage even in the case of excluding washing process.

It is a second object of the present invention to provide a method for the processing of a silver halide color photographic light-sensitive material capable of attaining the highly efficient recovery of the silver and elimination of pollution load.

And it is a third object of the present invention to provide a method for the processing of a silver halide color photographic light-sensitive material which uses stabilization baths designed so as to prevent the formation of precipitates during standing in a long interval or in the long lapse of time.

As a result of our studies, we have found that the above-described objects can be achieved by the application of such a stabilization process that, after being processed in a fixing bath or a bleach-fixing bath, stabilizes in a stabilization a silver halide color photographic light-sensitive material without through a substantial washing, the stabilization bath consisting of a plurality of stabilization baths which are replenished by a multistage counterflow system, the replenishing quantity to the stabilization bath being in the range from three to fifty times as much as the quantity of a processing solution brought into the first stabilization bath from a preceding bath by a unit area of the light sensitive materials, and at least the final bath of said stabilization baths having pH of from 2.0 to 6.5.

The method for the processing of the present invention is such that the stabilization is effected by way of a number of baths wherein a replenishment is made from the bath in the rear stage in a quantity within a specified range per unit area of the light-sensitive material being transported through the baths, and with a system wherein the overflow resulting from the replenishment made to the said rear bath is introduced into the preceding bath, the closer to the rear the stabilization baths the less influenced by the fixing or bleach-fixing chemical content brought in, whereby the baths are always maintained fresh, thus making possible to prevent the rise of the pH and formation of precipitates, resulting in not only the raise of the stability in storage of the color photographic image with the permission of eliminating a washing process but the facilitation of the highly efficient silver recovery and elimination of pollutant from the overflow from the front bath.

The "stabilization without through a substantial washing" of the present invention does not exclude such an extreme short-time rinsing in a single bath or a multi-bath counterflow system to such an extent that the concentration of the fixing or bleach-fixing solution in the frontmost stabilization bath does not become less than 1/1000; the auxiliary washing; and the processing with the known washing accelerating bath.

In addition, the fixing in the present invention is to be effected in a processing bath containing a soluble complex salt making agent which solubilizes silver halides to be silver halide complex salts, said bath including not only a commonly applied fixing bath but also bleach-fixing bath, combined developing and fixing bath, and combined developing-bleach-fixing bath.

To be more in detail, when photographic processings are made in succession, the fixing bath and bleach-fixing bath contain the soluble silver ions aside from the thiosulfate and sulfite of the fixing agent, so that the baths, when subjected to oxidation, produce the precipitate of the silver sulfide. And, regarding the formation of such silver sulfide, it has been said that in the case of such a solution containing highly concentrated constituents as fixing and bleach-fixing solutions, in general, the lower the pH the sooner does the decomposition of the thiosulfate take place, so that the formation of the precipitate of silver sulfide is effected rapidly.

However, it has been found that contrary to the expectation, in such a low concentration of the fixing and bleach-fixing agents as brought into the stabilization baths of the present invention, on the contrary, the higher the pH the more does the silver sulfide tend to form the precipitate thereof, and in the processing method of the present invention the precipitation is apt to take place in the pH of 7.0 or more, and when in the proximity of 8 the precipitation takes place in an extremely short period of time.

Further, it has also become apparent that in a low concentration of silver ions, when the relatively lower the silver ions the higher the pH is, the precipitation is prone to take place, while when the relatively higher the silver ions the harder is the precipitation to take place even when the pH exceeds 7.0.

The present invention is what has been established on the basis of the above facts. Since, as has been hereinbefore mentioned, the stabilization process consists of a plurality of baths wherein the replenishment of stabilizing solution is made in a counterflor system, though the first bath, wherein fixing agent is mixed in so that the pH tends in time to rise, contains highly concentrated silver ions, the rearward baths containing very small concentration of silver ions are maintained in the pH of from 2.0 to 6.5 by the fresh stabilization replenishing solution, so that all the stabilization baths have become able to be prevented from the formation of precipitates.

In accordance with the processing method of the present invention, the pH value of the color photographic image-carrying emulsion of the photosensitive material may be substantially maintained in such lower values that make possible the highest stability of the dye image during the storage thereof, and also the method has enabled to remove most of the pollutant from the emulsion, and to accomplish a rapid processing operation due to the elimination of a washing process.

The pH of the stabilization baths of the present invention is required to be within the range of from 2.0 to 6.5 in order to prevent the formation of precipitates and to obtain the stability of the color photographic image during the period of the storage thereof, and is also required to have an ability as a buffer. The buffering ability in this case is required in the successive processing to restrain the rise of the pH caused by the mixing of the fixing solution or bleach-fixing solution into the stabilization baths from the fixing bath or bleach-fixing bath preceding of the stabilization bath; to be more concrete, it is used to restrain the pH of the solution so as to be 9.0 or less, preferably 8.0 or less at the time when the solution into which is mixed 1 part of the liquid from the preceding bath to 3 parts of the stabilization bath is stored in an open air at the temperature of 25° C. over a period of 5 days.

In the stabilization process of the present invention, as has been mentioned above, the process is composed of a number of baths wherein a replenishment is made to the final bath, which then causes in order from the bath to the frontward baths to overflow, and the final over flow from the first bath are discarded to be provided for the recovery of silver or for the elimination of the pollutant.

Therefore, the closer to the front position the bath is, the stronger is the pH of the bath influenced by the preceding fixing bath or bleach-fixing bath, so that the pH of the front end stabilization bath having a high concentration of silver ions is not necessarily required to be fallen into the range of from 2.0 to 6.5 of the present invention; rather, a higher pH than the said range should be preferred for the purpose of preventing the formation of precipitates. There would be no problem if the pH is at least 9.0 or less.

Consequently, the final stabilization bath having a very low silver ion concentration is required to have the pH in the range of from 2.0 to 6.5 of the present invention, most preferably from 3.0 to 6.5, for the stabilization of the color photographic image during the storage thereof. If the pH is higher, exceeding the range or lower than the range, precipitates tend to be formed, and the deterioration of the color photographic image tends to be increased as well.

For the reason stated above, the stabilization process of the present invention has been designed so as to consist of a plurality of baths, but the number of the baths necessary to accomplish the foregoing objects is in close relations with the quantity brought in by the photosensitive material and the quantity to be replenished, and the smaller the ratio of the quantity to be replenished to that brought in the larger is the number of the baths necessary, while the larger the ratio; i.e., the larger the quantity to be replenished the smaller is the number of the baths enough.

The quantity of a processing solution brought into the first stabilization bath of this invention, Q, may be decided as following step. After being processed in the fixing bath or bleach-fixing bath, the light sensitive material is cut in unit length just before it is brought into the first stabilization bath. The weight of the light sensitive material at this time is given as W. And after that the light sensitive material is washed, dried, and weighed. The weight of the light sensitive material at this time is given as D. Q may be difined by the following formula.

$$Q = \frac{W - D}{d}$$

In this formula, d is the specific gravity of the fixing bath or the bleach-fixing bath.

Generally speaking, when the quantity to be replenished is from 3 to 5 times the quantity brought in, the processing with from 9 to 10 baths is necessary, while in the case of 50 times, the processing with from 3 to 4 baths is required to accomplish the objects.

The stabilizing solution of the invention is usable if its controlled to be of the pH within the range of from 2.0 to 6.5, so that various buffers may be used which include, e.g., borates, metaborates, borax, phosphates, monocarboxylates, dicarboxylates, polycarboxylates, oxycarboxylates, amino acids, aminocarboxylates, phosphorous salts, phosphoric salts, triphosphates, sodium hydroxide, potassium hydroxide, and the like. And various sequestering agents may also be used. As concrete examples of them there may be cited aminopolycarboxylates, aminopolyphosphoric acid, phosphonocarboxylic acid, alkylidenediphosphonic acid, polyphosphoric acid, metaphosphoric acid, gluconic acid, nitro polyphosphoric acid and the like. Various fungicide may be used: e.g., thiazolyl benzimidazole derivatives, formaldehyde, 3-isothiazolinones derivatives, 1,2-benzisothiazoline 3-one derivative, benzyl bromoacetate, hydantoin derivatives, gluconic acid, and the like.

Generally known additives to the stabilization bath aside from the above include, e.g., brightening agents, surface active agents, antimould agents, antiseptics, organic sulfur compounds, onium salts, hardeners, various metallic salts, and the like. Any of these compounds may be added singly or in any combination, or in any quantities within the range which is necessary for maintaining the pH range of the stabilization baths of the present invention and which does not exert any bad influence upon the stability of the color photographic image during the storage thereof nor causes the formation of any precipitates. However, although the processing method of the present invention makes possible a highly efficient silver recovery and elimination of pollutants, the lower the concentration of the above additives the better provided that they have sufficient buffering abilities from the view point of measures for antipollution and costs therefor.

The temperature to be applied to the stabilization process should be from 15° C. to 60° C., preferably from 20° C. to 45° C. The preferred processing time, though it should be as short as possible from the standpoint of the preference for rapid processing, is normally from 20 seconds to 10 minutes, most preferably from 1 to 5 minutes. It is preferred that shorter time is applied to the frontward baths, while longer time to the rearward baths.

No washing process is required at all after the stabilization process, but a rinsing or the washing of the surface with a small quantity of water within an extremely short period is allowed to be arbitrarily made at need.

Such method for the stabilization of the present invention may also be applied to the processing of color paper, reversal color paper, color positive film, color negative film, color reversal film, color X-ray film, and the like.

EXAMPLE 1

A Sakura Color Paper in roll (manufactured by Konishiroku Photo Ind. Co., Ltd.), after being imagewise printed, was processed with a successive replenishment (hereinafter referred to as a running processing) in an automatic processor. The processing steps and the compositions of the processing solutions employed in this case are as follows:

The basic processing steps:

| | | | |
|---|---|---|---|
| 1. | Color developing | at 33° C. | for 3 min. 30 sec. |
| 2. | Bleach-fixing | at 33° C. | for 1 min. 30 sec. |
| 3. | Stabilizing | at 25-30° C. | for 3 min. |
| 4. | Drying | at 75-80° C. | for about 2 min. |

The compositions of the processing baths:

| | |
|---|---|
| **Color Developing Tank Solution:** | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N-ethyl-N-(β-methanesulfonamide ethyl)-aniline sulfate | 5.5 g |
| Brightening agent (4,4'-diamino stilbenedisulfone derivative) | 1.0 g |
| Potassium hydroxide | 2.0 g |
| Water to make 1 liter | |
| **Color Development Replenisher:** | |
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| Polyphosphoric acid (TPPS) | 3.0 g |
| 3-methyl-4-amino-N-ethyl-N-(β-methanesulfoneamide ethyl)-aniline sulfate | 7.0 g |
| Brightening agent (4,4'-diamino-stilbenedisulfone derivative) | 1.5 g |
| Potassium hydroxide | 3.0 g |
| Water to make 1 liter | |

-continued

| | |
|---|---|
| **Bleach-Fixing Tank Solution:** | |
| Ferric ethylenediamine tetraacetate ammonium, dihydrated | 60 g |
| Ethylenediamine tetraacetate | 3 g |
| Ammonium thiosulfate (70% solution) | 100 ml |
| Ammonium sulfite (40% solution) | 27.5 ml |
| Adjust pH to be 7.1 with potassium carbonate or glacial acetic acid, and add water to make 1 liter | |
| **Bleach-Fixing Solution Replenisher A** | |
| Ferric ethylenediamine tetraacetate ammonium, dihydrated | 260 g |
| Potassium carbonate | 42 g |
| Water to make 1 liter (pH of this solution should be 6.7 ± 0.1) | |
| **Bleach-Fixing Solution Replenisher B** | |
| Ammonium thiosulfate (70% solution) | 500 ml |
| Ammonium sulfite (40% solution) | 250 ml |
| Ethylenediamine tetraacetate | 17 g |
| Glacial acetic acid | 85 ml |
| Water to make 1 liter (pH of this solution should be 4.6 ± 0.1) | |

The automatic processor was filled with the above-described color developing tank solution, bleach-fixing tank solution and the following stabilizing solution. And a running test was made in such a manner that while processing a color paper, the above-described color development replenisher, bleach-fixing solution replenishers A and B, and stabilizing solution replenisher were added at 3-minute intervals through the respective measure cups provided therefor. The replenishing quantities were 324 ml/m$^3$ for the replenishment to the color developing solution tank and 25 ml/m$^3$ each for the replenishments of the bleach-fixing solution replenishers A and B to the bleach-fixing solution tanks respectively.

For the stabilization processing, three automatic processors were remodeled so as to be provided with three baths, 6 baths, and 9 baths as stabilizing baths respectively so that successive processings can be effected. The stabilizing baths of the respective automatic processors were regarded as the 1st bath to the 3rd bath, the 1st bath to the 6th bath, and the 1st bath to the 9th bath respectively in the travelling direction of the photosensitive material. There was applied such a multi stage counterflow system that replenishments were made to the respective final baths the overflows from which were introduced to the respective preceding baths the overflows from which were further introduced to the preceding baths, thus repeating the same backward, i.e., flowing toward the first baths. In addition, as control, an automatic processor provided with one bath only was used.

Successive processings were made until the total used amount of the bleach-fixing solution replenishers A and B came to the same as the tank capacity for the bleach-fixing solution, and after that, the processing with the following stabilizing solution was carried out.

The pHs of the stabilizing solutions in the stabilization processing baths were measured, the presence of precipitates was visually examined, and the resulting samples after the processing were allowed to stand over a period of six weeks in the atmospheric condition of the temperature of 60° C. with the relative humidity of 80%, and afterward measurements were made on their minimum blue densities. The results are shown in Table 1.

In addition, the quantity of the bleach-fixing solution per m$^2$ of the color paper that was brought into the stabilizing solution was 50 ml.

| Stabilizing Solution - 1 | |
|---|---|
| 1-Hydroxy ethyliden-1,1-diphosphoric acid | 2 g |
| Form aldehyde | 0.2 g |
| 1-2 Benzisothiazoline-3-one | 0.5 g |
| Water to make 1 liter, whose pH was controlled to be 4.0 with sodium hydroxide | |

TABLE 1

| | Stabilization bath composition | Replenishing quantity of stabilizer (ml/m2) | Bath | pH | Precipitate | Minimum blue density |
|---|---|---|---|---|---|---|
| Control 1 | 1 bath | 500 ml | 1st bath | 7.5 | present | 0.42 |
| Control 2 | 1 bath | 1000 ml | 1st bath | 7.12 | present | 0.40 |
| Control 3 | 1 bath | 2800 ml | 1st bath | 6.3 | present | 0.32 |
| Control 4 | 3 baths | 100 ml | 1st bath | 8.0 | present | 0.48 |
| | | | 2nd bath | 7.8 | | |
| | | | 3rd bath | 7.7 | | |
| Control 5 | 6 baths | 50 ml | 1st bath | 8.0 | present | 0.55 |
| | | | 3rd bath | 8.0 | | |
| | | | 6th bath | 7.9 | | |
| Invention 1 | 3 baths | 500 ml | 1st bath | 7.5 | none | 0.17 |
| | | | 2nd bath | 6.0 | | |
| | | | 3rd bath | 4.5 | | |
| Invention 2 | 3 baths | 1000 ml | 1st bath | 7.1 | none | 0.15 |
| | | | 2nd bath | 5.5 | | |
| | | | 3rd bath | 4.3 | | |
| Invention 3 | 6 baths | 500 ml | 1st bath | 7.5 | none | 0.13 |
| | | | 2nd bath | 6.0 | | |
| | | | 3rd bath | 4.5 | | |
| | | | 4th bath | 4.2 | | |
| | | | 5th bath | 4.2 | | |
| | | | 6th bath | 4.2 | | |
| Invention 4 | 6 baths | 1000 ml | 1st bath | 7.1 | none | 0.13 |
| | | | 2nd bath | 5.5 | | |
| | | | 3rd bath | 4.3 | | |
| | | | 4th bath | 4.2 | | |
| | | | 5th bath | 4.2 | | |
| | | | 6th bath | 4.2 | | |
| Invention 5 | 9 baths | 250 ml | 1st bath | 7.8 | none | 0.13 |
| | | | 2nd bath | 7.1 | | |
| | | | 3rd bath | 5.9 | | |
| | | | 4th bath | 4.8 | | |
| | | | 5th bath | 4.3 | | |
| | | | 6th bath | 4.2 | | |
| | | | 7th bath | 4.2 | | |
| | | | 8th bath | 4.2 | | |
| | | | 9th bath | 4.2 | | |
| Invention 6 | 9 baths | 500 ml | 1st bath | 7.5 | none | 0.13 |
| | | | 2nd bath | 6.0 | | |
| | | | 3rd bath | 4.5 | | |
| | | | 4th bath | 4.3 | | |
| | | | 5th bath | 4.2 | | |
| | | | 6th bath | 4.2 | | |
| | | | 7th bath | 4.2 | | |
| | | | 8th bath | 4.2 | | |
| | | | 9th bath | 4.2 | | |
| Invention 7 | 9 baths | 1000 ml | 1st bath | 7.1 | none | 0.13 |
| | | | 2nd bath | 5.5 | | |
| | | | 3rd bath | 4.3 | | |
| | | | 4th bath | 4.2 | | |
| | | | 5th bath | 4.2 | | |
| | | | 6th bath | 4.2 | | |
| | | | 7th bath | 4.2 | | |
| | | | 8th bath | 4.2 | | |

TABLE 1-continued

| Stabilization bath composition | Replenishing quantity of stabilizer (ml/m2) | Bath | pH | Precipitate | Minimum blue density |
|---|---|---|---|---|---|
| | | 9th bath | 4.2 | | |

As apparent from Table 1, in the stabilization processings not based on the present invention (Control-1 to Control-5), because of the single composition of stabilization baths, there appeared much yellow stain shown with the minimum blue densities regardless of whether the replenishing quantities were within or out of the range of the present invention, and also because the renewal rate of the tank solution was inefficient, precipitates of silver sulfide and iron hydroxide were formed, thus causing such a trouble that the precipitates were attached onto the color paper. Further, even when the number of the stabilization baths were increased to three or six, the stabilizing solution replenishing quantities out of the range of the present invention also resulted in the significant formation of yellow stain and precipitates.

On the other hand, in the stabilization processings of the present invention (Invention-1 to Invention-7), all the cases showed little stain indicated with the minimum blue densities and no formation of any precipitates or mould.

In addition, in an experiment of the present example (Invention-3), the stabilizing solution replenisher was divided into two; 250 ml each was separately added to the 6th bath and 4th bath, but there was observed no substantial difference in the effect.

Besides the present example, a color negative film, after being fixed with SAKURA CNK-4, was subjected to a stabilization processing in the same manner as in the experiment of the present invention (Invention-3), and as a result, a similar effect was obtained. Further, in the processings of the present invention (Invention-1 to Invention-7) in the present example, a 20-second rinsing was applied to each of the processings, but no difference in yellow stain was observed.

EXAMPLE 2

With the use of a color paper in automatic processors under a similar condition to that of the experiment of Example 1 (Invention-3) successive processings were continued over a period of 30 days until the total amount of the used bleach-fixing solution replenisher came to the bleach-fixing solution tank capacity.

As a stabilizing solution, a solution containing the following chemicals per liter of water was used.

| Stabilizing solution (Replenisher) | |
|---|---|
| Acetic acid | 3.0 ml |
| Folm aldehyde | 0.5 g |
| Sodium benzoate | 0.2 g |
| 1-hydroxyethylidene-1,1'-diphosphonic acid | 0.5 g |
| 1-2 benzisothiazoline-3-one | 0.2 g |

The resulting solution was divided into four, whose pHs were controlled to be 1.5, 4.0, 6.0 and 7.5 respectively by the use of glacial acetic acid and sulfuric acid.

Successive processings were made using the replenisher as it is in place of the stabilizing solution in the tank, and with the replenishing amount of 500 ml per $m^2$ of the photosensitive material to be processed, and after that measurements were made on the respective pH values of the baths of from the 1st to the 6th, and at the same time the presence of precipitates in these baths were visually examined. Further, the processed samples were allowed to stand over a period of four weeks in the atmospheric condition of the relative humidity of 80% at 60° C. to measure the minimum blue densities and a period of two weeks in the same condition to measure the maximum red densities.

TABLE 2

| | pH of replenisher | Bath | pH | Presence of precipitates | Minimum blue density | Max. red density (dye residual percent) |
|---|---|---|---|---|---|---|
| | | 1st bath | 6.8 | none | | |
| | | 2nd bath | 5.4 | none | | |
| Control | | 3rd bath | 3.8 | none | | |
| 6 | 1.5 | 4th bath | 2.2 | present | 0.10 | 30% |
| | | 5th bath | 1.9 | slight | | |
| | | 6th bath | 1.9 | none | | |
| | | 1st bath | 7.2 | none | | |
| | | 2nd bath | 5.8 | none | | |
| Invention | | 3rd bath | 5.0 | none | 0.12 | 98% |
| 8 | 4.0 | 4th bath | 4.5 | none | | |
| | | 5th bath | 4.2 | none | | |
| | | 6th bath | 4.2 | none | | |
| | | 1st bath | 7.8 | none | | |
| | | 2nd bath | 7.3 | none | | |
| Invention | 6.0 | 3rd bath | 6.7 | none | 0.15 | 94% |
| 9 | | 4th bath | 6.4 | none | | |
| | | 5th bath | 6.2 | none | | |
| | | 6th bath | 6.2 | none | | |
| | | 1st bath | 8.9 | none | | |
| | | 2nd bath | 8.6 | none | | |
| Control | 7.5 | 3rd bath | 8.2 | present | 0.26 | 78% |
| 7 | | 4th bath | 7.9 | present | | |
| | | 5th bath | 7.8 | slight | | |
| | | 6th bath | 7.6 | none | | |

As apparent from Table 2, in the experiments not based on the present invention (Control-6 and Control-7), the relation between the metal ion concentration brought into the stabilizing solution and the pH does not show any desirable results, and there appeared the formation of precipitates in some of the stabilization processing baths. Further, in the cases where the pH values of the replenishers are 1.5 and 7.5, in the lower pH, although the minimum blue densities are satisfactory, the maximum red densities are largely discolored, while in the higher pH, although the discoloration degrees of the maximum red densities fall within a tolerable range, the minimum blue densities are too high, thus resulting in a color print untolerable for practical use.

On the other hand, when processed in the range of the pH of the stabilizing solution replenisher of the present invention, there were obtained such satisfactory results that both the minimum blue densities and maximum red densities provided no problems at all on the preservability of the dye image, and not only that, no occurrence of precipitates was observed.

In addition, in the present example, to the stabilizing solution were added a phosphate, polyphosphate, aminocarboxylate and the like, but there was observed no substantial difference in the stability of the dye image.

And in the case where the remaining time of the stabilizing solution becomes longer because of small quantities of photosensitive material in the succesive processing, to the stabilizing solution of the present invention were added such antimould agents as isothiazoline-3-one compounds, 1-bromo-3-chloro-55-dimethylhydantoin and the like, and as a result, a satisfactory effect by such agents were observed.

What is claimed is:

1. In a method for the processing of a silver halide color photographic light-sensitive materials wherein said material, after being processed in a fixing bath or a bleach-fixing bath, is processed in a stabilization bath without through a substantial washing process, the improvement characterized in that the stabilization bath consists of a plurality of baths which are replenished by a multistage counterflow system, the replenishing quantity to the stabilization bath being in the range from three to fifty times as much as the quantity of a processing solution brought into the first stabilization bath from a preceding bath by a unit area of the light sensitive materials, and at least the final bath of said stabilization bath having a pH value of from 2.0 to 6.5.

2. In a method according to claim 1, the stabilization bath comprises a buffering compound, a sequestering agent and a fungicide.

3. In a method according to claim 1, the stabilization bath consists of more than three baths.

4. In a method according to claim 1, the final bath of the stabilization bath has a pH value of from 3.5 to 6.5.

* * * * *